US010925352B2

(12) United States Patent
LeCompte et al.

(10) Patent No.: US 10,925,352 B2
(45) Date of Patent: Feb. 23, 2021

(54) BUTTON ASSEMBLY WITH REMOVABLE CAP

(71) Applicant: YKK Corporation, Tokyo (JP)

(72) Inventors: Chuck G. LeCompte, Lawrenceburg, KY (US); Garland Jesse Brock, Lawrenceburg, KY (US); Jonathan H. Sharp, Lawrenceburg, KY (US); Joshua T. Butsch, Lawrenceburg, KY (US)

(73) Assignee: YKK Corporation

( * ) Notice: Subject to any disclaimer, the term of this patent is extended or adjusted under 35 U.S.C. 154(b) by 51 days.

(21) Appl. No.: 16/505,897

(22) Filed: Jul. 9, 2019

(65) Prior Publication Data

US 2020/0015551 A1 Jan. 16, 2020

Related U.S. Application Data

(60) Provisional application No. 62/696,672, filed on Jul. 11, 2018.

(51) Int. Cl.
*A44B 1/08* (2006.01)
*A44B 1/06* (2006.01)

(52) U.S. Cl.
CPC . *A44B 1/08* (2013.01); *A44B 1/06* (2013.01)

(58) Field of Classification Search
CPC .... A44B 1/06; A44B 1/08; A44B 1/14; A44B 1/28
See application file for complete search history.

(56) References Cited

U.S. PATENT DOCUMENTS

| | | | | |
|---|---|---|---|---|
| 2,622,291 | A * | 12/1952 | Drell | A44B 1/28 24/109 |
| 4,346,507 | A * | 8/1982 | Heuck | A44B 1/06 29/243.519 |
| 6,618,909 | B1 * | 9/2003 | Yang | A44B 1/08 24/113 MP |
| 10,064,441 | B1 * | 9/2018 | Provencher | A41F 1/002 |
| 2002/0039493 | A1 * | 4/2002 | Tanaka | G03B 17/00 396/543 |
| 2016/0000189 | A1 * | 1/2016 | Bolen | A44B 1/30 24/303 |

FOREIGN PATENT DOCUMENTS

KR 20-0179268 Y1 5/2000

* cited by examiner

*Primary Examiner* — Robert Sandy
*Assistant Examiner* — David M Upchurch
(74) *Attorney, Agent, or Firm* — Kilpatrick Townsend & Stockton LLP

(57) ABSTRACT

A button assembly includes a top assembly, an attachment body, and a resilient member. The top assembly includes a cap and a locking ring defining a receiving area, and the locking ring includes a top protrusion extending into the receiving area. The attachment body includes a locking feature that includes a body protrusion and a notched portion. The resilient member is located between the cap and the attachment body such that the cap is movable toward the attachment body. In some examples, the top assembly is selectively engageable with the attachment body by aligning the top protrusion of the locking ring with the notched portion of the locking feature, pushing the top assembly toward the attachment body, and rotating the top assembly relative to the attachment body such that the top protrusion of the locking ring is aligned with the body protrusion of the locking feature.

20 Claims, 15 Drawing Sheets

BUTTON ASSEMBLY WITH REMOVABLE CAP

REFERENCE TO RELATED APPLICATION

This application claims the benefit of U.S. Provisional Application No. 62/696,672, filed Jul. 11, 2018 and titled REMOVABLE TOP BUTTON, the content of which is hereby incorporated by reference in its entirety.

FIELD OF THE INVENTION

This application relates to a button assembly, and, more particularly, to a button assembly with a removable cap.

BACKGROUND

Buttons are used in a number of industries as fasteners, ornaments, combinations thereof, etc. Some types of buttons include a button body and fastener. Such buttons are assembled on a piece of material such as fabric by positioning the button body and fastener on opposite sides of the material and then engaging the fastener with the button body through the material such that the button body is fixed to the fabric. Once assembled, the button remains fixed on the material and it generally cannot be removed (e.g., to change the button, replace the button if broken, etc.) without completely disassembling the button. Moreover, because such buttons are typically assembled on the material by the manufacturer of the product, consumers are generally unable to remove and/or change the button and cannot customize the button.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain examples, a button assembly includes a top assembly, an attachment body, and a resilient member. The top assembly includes a cap and a locking ring defining a receiving area, and the locking ring includes a top protrusion extending into the receiving area. The attachment body includes a locking feature that includes a body protrusion and a notched portion. The resilient member is between the cap and the attachment body such that the cap is movable toward the attachment body. In various aspects, the top assembly is selectively engageable with the attachment body by aligning the top protrusion of the locking ring with the notched portion of the locking feature, pushing the top assembly toward the attachment body, and rotating the top assembly relative to the attachment body such that the top protrusion of the locking ring is aligned with the body protrusion of the locking feature.

According to various examples, a button assembly includes a top assembly, an attachment body, and a resilient member. The top assembly includes a top protrusion and a cap that defines a receiving area, and the top protrusion extends into the receiving area. The attachment body includes a locking feature that includes a body protrusion and a notched portion. The resilient member is between the top assembly and the attachment body such that the top assembly is movable toward the attachment body. In some cases, the top assembly is selectively engageable with the attachment body by aligning the top protrusion with the notched portion of the locking feature, pushing the top assembly toward the attachment body, and rotating the top assembly relative to the attachment body such that the top protrusion is aligned with the body protrusion of the locking feature.

According to some examples, a method of assembling a top button includes positioning a top assembly relative to an attachment body. The top assembly includes a receiving area and a top protrusion within the receiving area, and the attachment body includes a locking feature with a body protrusion and a notched portion. Positioning the top assembly includes aligning the top protrusion with the notched portion of the locking feature. The method also includes pushing the top assembly toward the attachment body, and rotating the top assembly relative to the attachment body such that the top protrusion is aligned with the body protrusion of the locking feature.

In certain embodiments, a removable top button includes a top assembly, an attachment body, and a mechanical spring. The top assembly includes a cap and a locking ring, where the locking ring includes a protruded area. The attachment body includes a locking feature with a recessed area and a protruded area. The mechanical spring is between the cap and the attachment body such that the cap is movable toward the attachment body. In certain aspects, the top assembly is selectively engageable with the attachment body by aligning the protruded area of the locking ring with the recessed area of the locking feature, pushing the top assembly toward the attachment body, and rotating the top assembly relative to the attachment body such that the protruded area of the locking ring is aligned with the protruded area of the locking feature.

In some examples, a method of assembling a top button includes positioning a top assembly relative to an attachment body and pushing the top assembly toward the attachment body. The top assembly includes a cap and a locking ring that includes a protruded area. The attachment body includes a locking feature that includes a protruded area and a recessed area. In various aspects, positioning the top assembly includes aligning the protruded area of the locking ring with the recessed area of the locking feature. The method also includes rotating the cap relative to the attachment body such that the protruded area of the locking ring is aligned with the protruded area of the locking feature.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

FIGS. 1-8 illustrate an example of a button assembly 100 according to aspects of the current disclosure. The button assembly 100 generally includes a top assembly 102 and an attachment body 104. As explained in greater detail below, the top assembly 102 is selectively engageable with the attachment body 104 such that the top assembly can be removed or be disengaged with the attachment body 104 as desired. In some examples, the selectively engageable top assembly 102 allows the top assembly 102 to be easily removed and/or replaced if the top assembly 102 becomes damaged or otherwise unsuitable for use. In other examples, the selectively engageable top assembly 102 allows the user to easily customize the button assembly because top assemblies 102 having different styles, designs, shapes, colors, logos, etc. can be easily removed and attached as desired. In certain cases, the selectively engageable top assembly 102 may reduce manufacturing costs for manufacturers having buttons with stylized designs because they need only produce the customized top assembly 102, which can then be assembled on a relatively universal attachment body 104. In further cases, the top assembly 102 may be selectively removed from the attachment body 104, and the attachment body 104 may still function as a button. In other words, in such cases, the attachment body 104 remains attached to the material after the top assembly 102 is removed, and the attachment body 104 optionally can still be used as a button to fasten pieces of material together.

Figure 1:
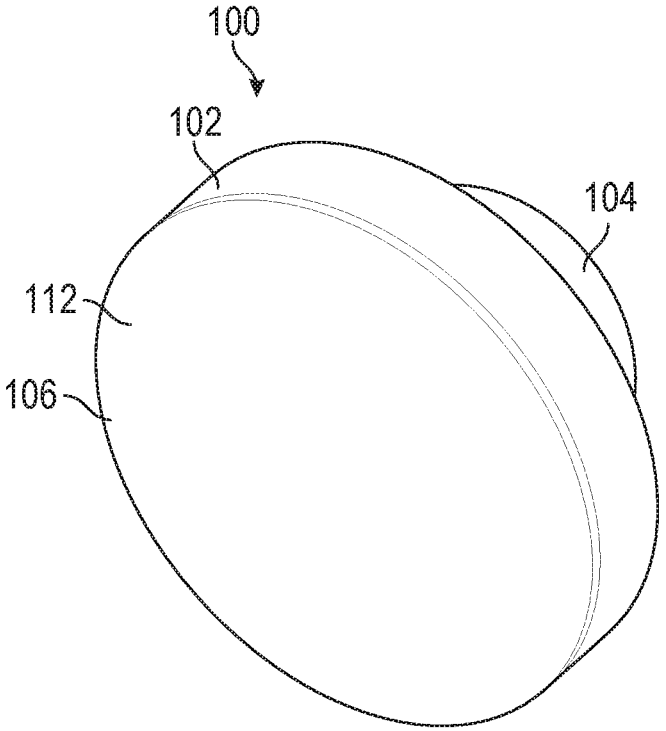
FIG. 1 is a perspective view of a button assembly according to aspects of the current disclosure.
Figure 2:
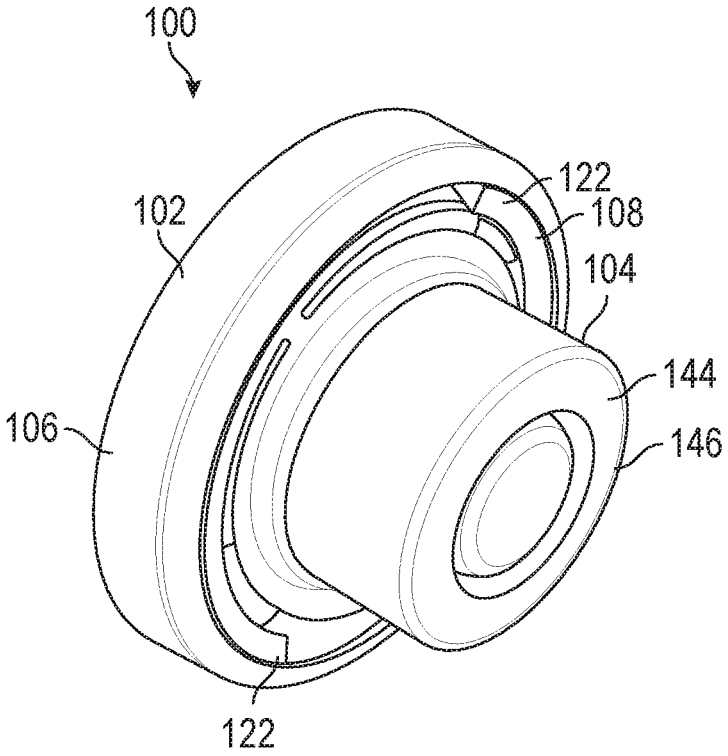
FIG. 2 is another perspective view of the button assembly of FIG. 1.
Figure 3:
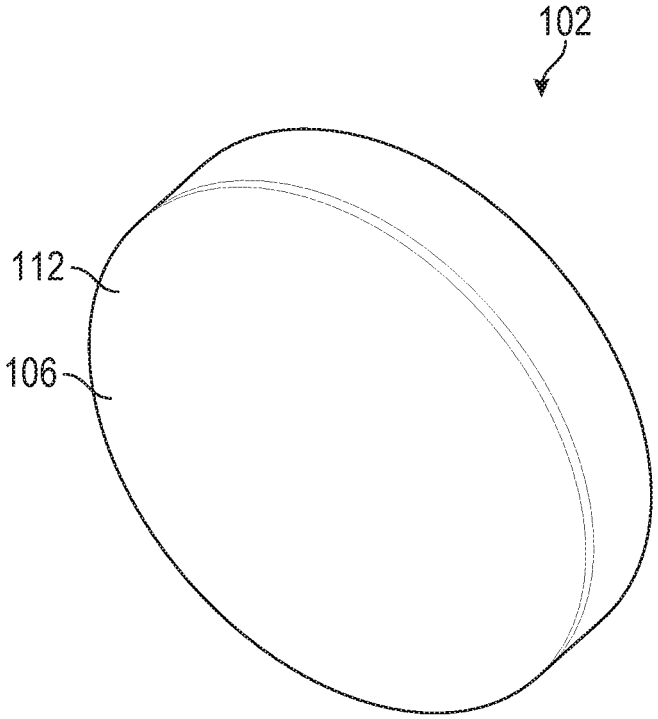
FIG. 3 is a perspective view of a top assembly of the button assembly of FIG. 1.
Figure 4:
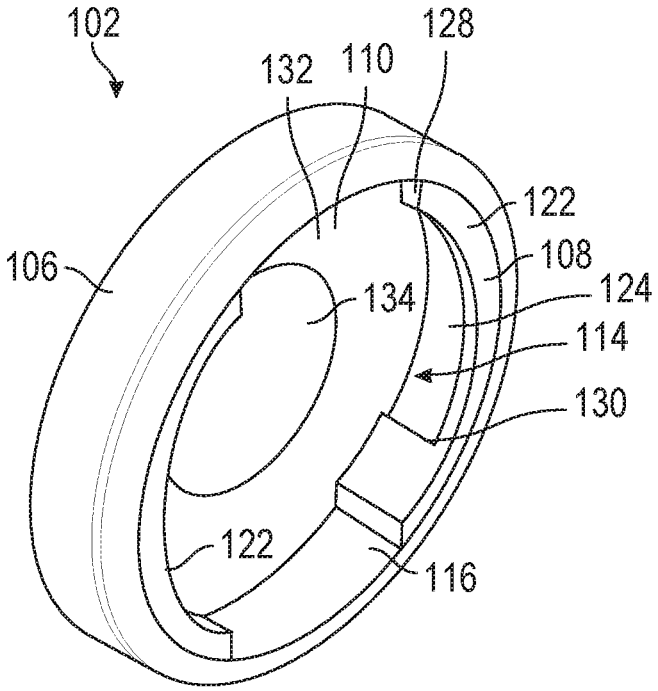
FIG. 4 is another perspective view of the top assembly of FIG. 3.
Figure 5:
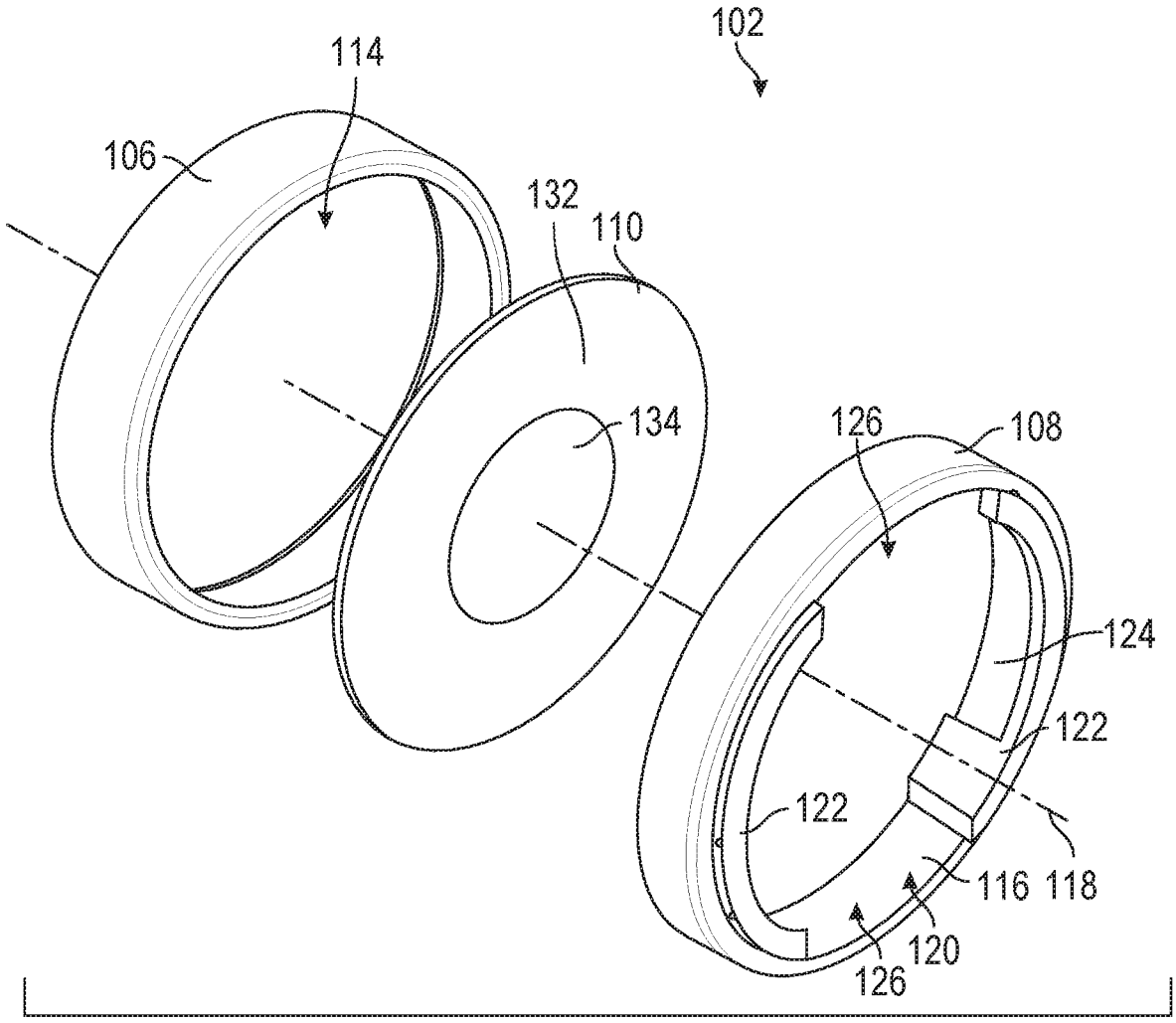
FIG. 5 is an exploded assembly view of the top assembly of FIG. 3.
Figure 6:
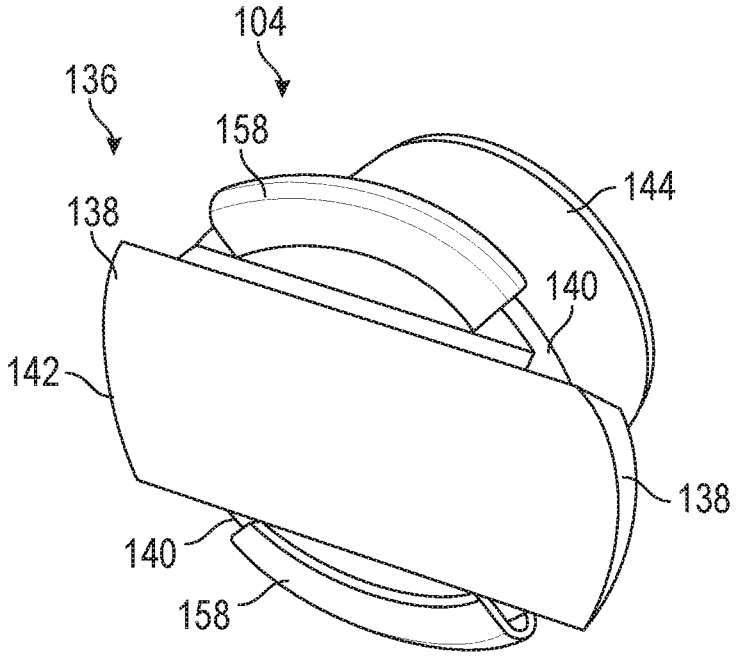
FIG. 6 is a perspective view of an attachment body of the button assembly of FIG. 1.
Figure 7:
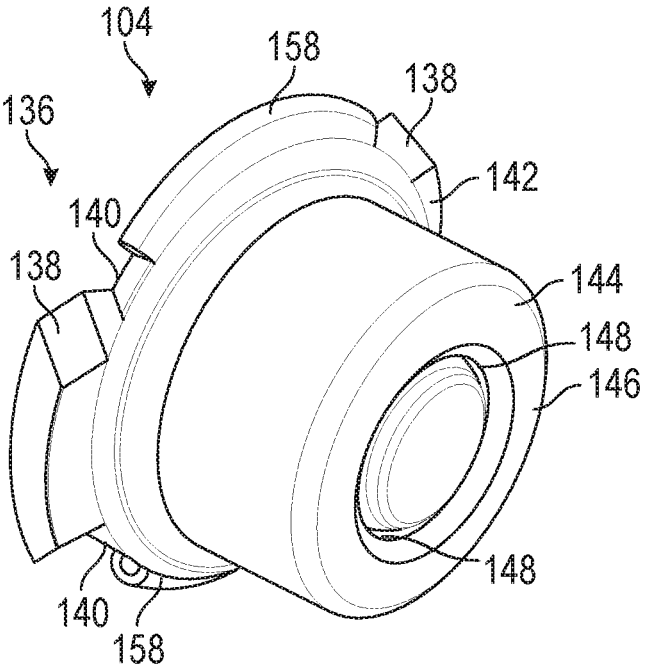
FIG. 7 is another perspective view of the attachment body of FIG. 6.

Referring to FIGS. 1-4, the top assembly 102 includes a cap 106 and a locking ring 108. In some optional examples, a resilient member 110 is also included with the top assembly 102; however, in other examples, the resilient member 110 may be provided with the attachment body 104, as discussed below. Whether the resilient member 110 is with the top assembly 102 and the attachment body 104, the resilient member 110 is positioned between the top assembly 102 and the attachment body 104 when assembled. In some examples, the cap 106 and locking ring 108 are separate components that are assembled together as illustrated in FIG. 5. In other examples, the cap 106 and locking ring 108 may be monolithically or integrally formed as a single component through various suitable forming techniques such as molding, printing, etc.

The cap 106 includes an outer surface 112 and defines a cap cavity 114. In the example of FIGS. 1-8, the cap 106 has a generally circular profile. However, in other examples, the cap 106 may have various other profile shapes as desired. When assembled on a material such as a garment fabric, the outer surface 112 is generally the portion of the button assembly 100 most visible to a viewer. In certain cases, the outer surface 112 includes various designs, shapes, colors, logos, embossments, and/or various other ornamental features or combinations of features as desired.

The locking ring 108 is retained within the cap cavity 114 of the cap 106. In the example of FIGS. 1-8, the locking ring 108 is retained within the cap cavity 114 through a lip of the cap 106. In other examples, the locking ring 108 may be retained within the cap cavity 114 through various other suitable fastening or securing mechanisms, which may be permanent or temporary mechanisms. As best illustrated in FIGS. 4 and 5, the locking ring 108 includes an inner surface 116 that defines a receiving area 120 having a central axis 118. In certain examples, the locking ring 108 includes at least one protrusion 122 that extends from the inner surface 116 into the receiving area 120. The number of protrusions 122 should not be considered limiting on the current disclosure. In the example of FIGS. 1-8, the locking ring 108 includes two protrusions 122. However, in other examples, the locking ring 108 may have a single protrusion or more than two protrusions. In one non-limiting example, the locking ring 108 with the single protrusion may include a cam-like feature providing increasing tension to a portion of the attachment body 104; however, various other features may be utilized with the single protrusion or locking ring 108 with more than one protrusion.

In various examples, each protrusion 122 defines a locking recess 124 that receives a portion of a locking feature of the attachment body 104, as discussed in detail below. In some cases, the locking recess 124 extends along a portion of the protrusion 122 such that one end 128 of the locking recess 124 is open and the opposing end 130 is closed. In some aspects, an access area 126 provides access to the open end 128 of each locking recess 124. The access areas 126 may be recessed relative to the protrusion 122 in some cases.

As mentioned, in some cases, the resilient member 110 is provided with the top assembly 102. The resilient member 110 may be various suitable devices or materials that are elastically deformable, including, but not limited to, wave springs, a metal disc with silicone, a spring washer, a coil spring, a solid piece of silicone, a solid piece of urethane, and/or various other suitable devices or combination of devices. In the example of FIGS. 1-9, the resilient member 110 is a metal disc 132 with silicone 134. As described in detail below, during assembly of the button assembly 100, the top assembly 102 is movable towards the attachment body 104 through the resilient member 110 such that the top assembly 102 can engage the attachment body 104. After the top assembly 102 is engaged with the attachment body 104, the resilient member 110 biases the top assembly 102 away from the attachment body 104 such that the position and/or orientation of top assembly 102 relative to the attachment body 104 is maintained. In some examples, when the resilient member 110 is provided with the top assembly 102, the resilient member 110 may be retained within the cap cavity 114. In some optional examples, the resilient member 110 may be retained within the cap cavity 114 between the locking ring 108 and the cap 106, although it need not be.

Referring to FIGS. 2 and 6-8, the attachment body 104 includes a locking feature 136 that selectively engages with the locking ring 108 to retain the top assembly 102 on the attachment body 104. In some cases, the locking feature 136 includes at least one protrusion 138 and at least one notched portion 140. In various aspects, an extent to which the at least protrusion 138 extends from the attachment body 104 is greater than an extent to which the at least one notched portion 140 extends from the attachment body 104. In certain aspects, the number of protrusions 138 of the attachment body 104 correspond with the number of locking recesses 124 of the locking ring 108. When the top assembly 102 is assembled with the attachment body 104, the locking feature 136 is at least partially positioned within the receiving area 120. In various aspects, to selectively engage the top assembly 102 with the attachment body 104, the locking feature 136 engages the locking ring 108 by positioning the protrusions 138 within the corresponding locking recesses 124 through the open ends 128.

In some optional examples, the attachment body 104 includes a slug 142 and a collet 144. In certain cases, and as illustrated in FIGS. 2 and 6-8, the slug 142 and collet 144 are separate components that are joined or fastened together. The slug 142 and collet 144 may be joined together through various suitable mechanisms. In the present example, the collet 144 includes clips 158 that overlap portions of the slug 142. In other examples, the slug 142 and collet 144 are monolithically or integrally formed as a single component (i.e., the attachment body 104 is a single component).

Figure 8:
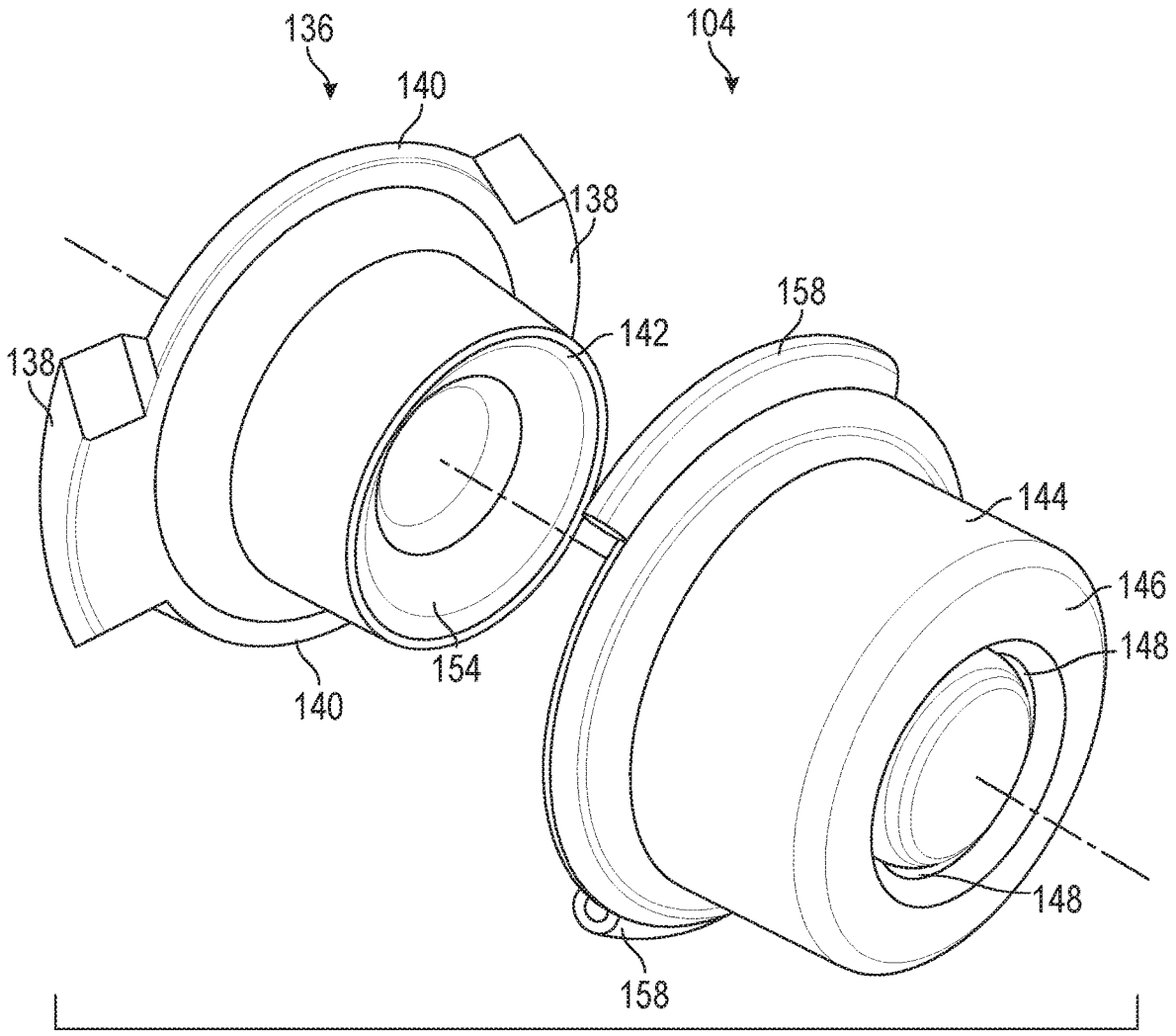
FIG. 8 is an exploded assembly view of the attachment body of FIG. 6.

In various examples, the collet 144 includes a fastening end 146 that defines one or more apertures 148 that receive a prong or prongs of a garment fastener such that the fastener is engaged with the attachment body 104. A fastener that is engageable with the attachment body 104 may include one prong, two prongs, or more than two prongs. In the present example, the fastening end 146 is adapted to receive a two-prong fastener. In other examples, other types of fasteners may be utilized to support the attachment body 104 on a piece of material, and the fasteners need not include prongs. In some cases, the slug 142 includes the locking feature 136, although it need not in other examples. As best illustrated in FIG. 8, in some optional cases, the slug 142 includes a shaping surface 154 that engages the prongs of the fastener when the prongs are inserted into the apertures 148 to further engage the fastener with the attachment body 104. Optionally, the shaping surface 154 at least partially deforms the prongs to further engage and retain the attachment body 104 with the fastener.

In certain optional examples, the top assembly 102 and/or the attachment body 104 includes an alignment guide that orients or positions the top assembly 102 in a predefined orientation relative to the attachment body 104 when assembled. In some cases, the alignment guide may be a positioning of the open end 128 of each locking recess 124 (e.g., the protrusion 138 of the locking feature 136 can only engage a corresponding locking recess 124 of a particular orientation due to the configuration or positioning of the open end 128). In other cases, the alignment guide may be surfaces on the locking ring 108 and/or the locking feature 136 that are angled or otherwise shaped such that the locking ring 108 can only engage the locking feature 136 in a predetermined orientation. In various cases, the alignment guide may be a visual indicator (marking, color, shape, line, logo, decal, design, etc.) on the outer surface 112 of the cap 106 indicating a correct orientation of the top assembly 102 relative to the attachment body 104. Various other suitable types of devices or materials may be utilized as an alignment guide in various other examples including, but not limited to, cut-outs, ribs, tabs, or other suitable mechanisms. In one non-limiting example where the locking ring 108 includes more than one protrusion 122, the alignment guide may include different sized protrusions 122. For example, one protrusion may be larger than another protrusion such that the attachment body 104 can only be assembled with the top assembly 102 in a particular configuration.

A method of assembling the button assembly 100 is also disclosed. In various examples, the method includes positioning the top assembly 102 relative to the attachment body 104. In some aspects, the attachment body 104 may be supported on a material with the fastener before positioning the top assembly 102 relative to the attachment body 104, although it need not be. The material may be various materials on which a button assembly 100 can be supported. In some examples, the material may be a fashion or apparel industry material such as various fabrics, leathers, cloths, denim, etc. Supporting the attachment body 104 on the material may include engaging prongs of the fastener through the material and into the apertures 148 of the attachment body 104 such that the attachment body 104 is retained on the material. In aspects, when the attachment body 104 is supported on the material, the locking feature 136 overlaps a portion of the material such that the attachment body 104 can still function as a button or fastener even if the top assembly 102 is disengaged or removed from the attachment body 104.

In certain cases, positioning the top assembly 102 relative to the attachment body 104 includes orienting the top assembly 102 relative to the attachment body 104 using an alignment guide. In various aspects, positioning the top assembly 102 relative to the attachment body 104 includes positioning the locking feature 136 of the attachment body 104 within the receiving area 120 of the locking ring 108. In some examples, positioning the locking feature 136 in the receiving area 120 includes aligning the protrusions 138 of the locking feature 136 with corresponding access areas 126 of the locking ring 108. Positioning the locking feature 136 in the receiving area 120 optionally includes aligning the notched portions 140 of the locking feature 136 with the protrusions 122 of the locking ring 108.

In some examples, the method includes pushing the top assembly 102 toward the attachment body 104 after the top assembly 102 is positioned relative to the attachment body 104. In certain aspects, pushing the top assembly 102 includes elastically deforming the resilient member 110.

The method includes rotating the top assembly 102 relative to the attachment body 104 such that the protrusions 138 of the locking feature 136 are aligned with the protrusions 122 of the locking ring 108. In such examples, when the top assembly 102 is rotated, the protrusions 138 of the locking feature 136 may no longer be aligned with the corresponding access areas 126 of the locking ring 108. In some cases, rotating the top assembly 102 includes positioning the protrusions 138 within corresponding locking recesses 124 of the locking ring 108. In some aspects, the protrusions 122 overlap the protrusions 138 when the protrusions 138 are within the locking recesses 124, and the protrusions 138 are retained between the locking ring 108 and the cap 106.

In various examples, the method includes releasing the top assembly 102 after rotating the top assembly 102 relative to the attachment body 104 such that the resilient member 110 biases the top assembly 102 away from the attachment body 104. In various aspects, releasing the top assembly 102 while the protrusions 138 are aligned with the protrusions 122 secures the top assembly 102 to the attachment body 104. In some cases, the resilient member maintains the position and orientation of the top assembly 102 relative to the attachment body 104. In some optional examples, the resilient member 110 prevents or minimizes rotation of the top assembly 102 relative to the attachment body 104 when the top assembly 102 is released.

Figure 9:
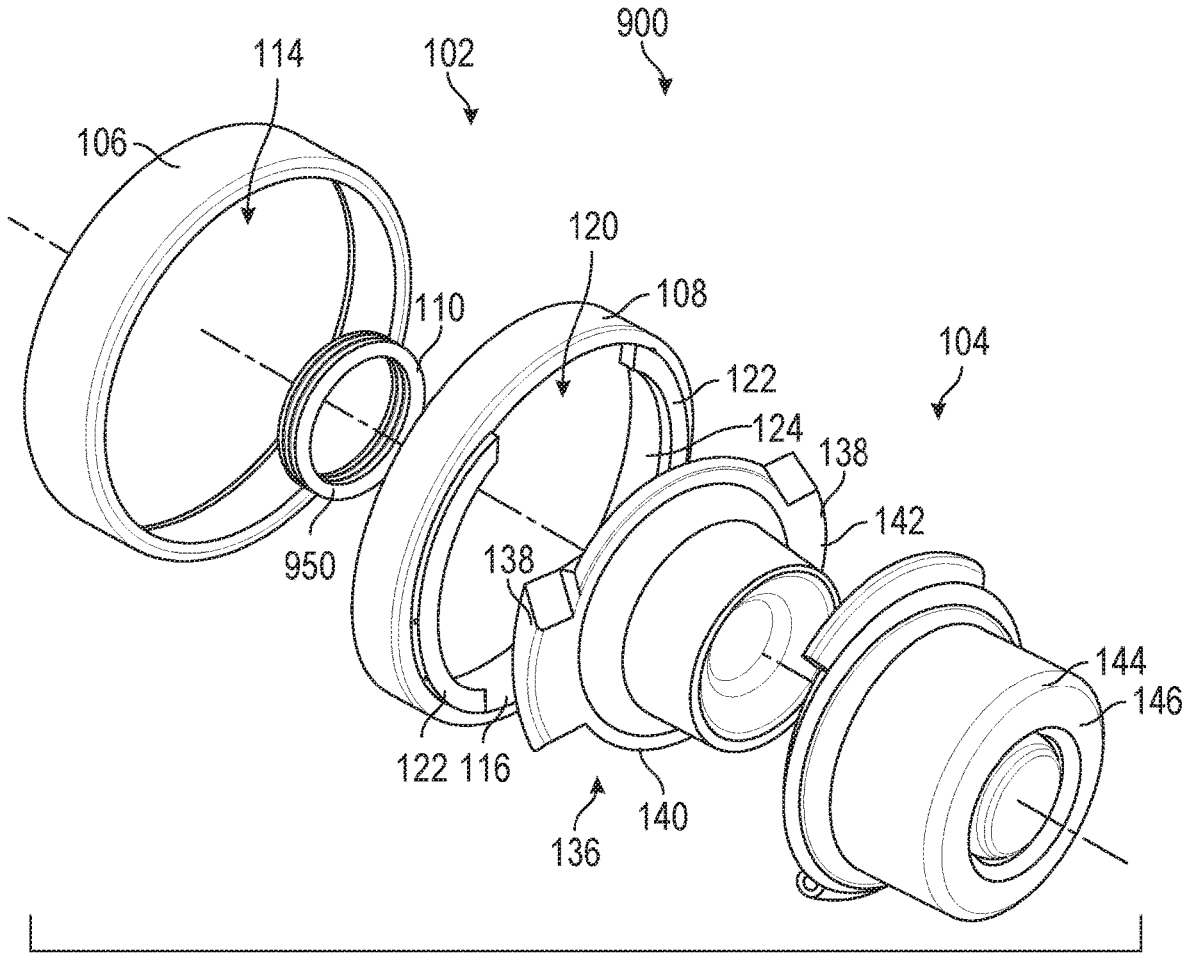
FIG. 9 is an exploded assembly view of a button assembly according to aspects of the current disclosure.

FIG. 9 illustrates another example of a button assembly 900 according to aspects of the current disclosure. The button assembly 900 is substantially similar to the button assembly 100 except that the resilient member 110 is a wave spring 950.

Figure 10:
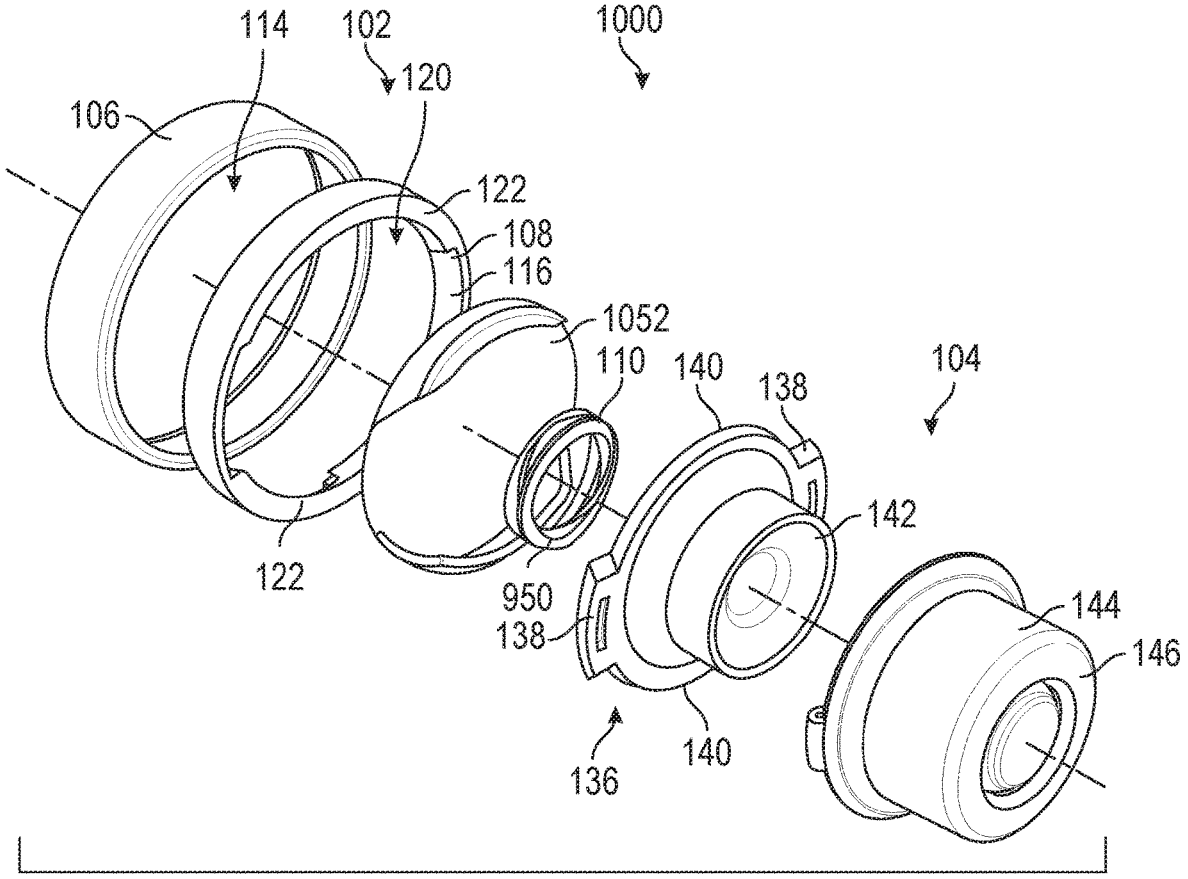
FIG. 10 is an exploded assembly view of a button assembly according to aspects of the current disclosure.

FIG. 10 illustrates another example of a button assembly 1000 according to aspects of the current disclosure. The button assembly 1000 is substantially similar to the button assembly 100 except that the resilient member 110 is the wave spring 950, and the resilient member 110 is included with the attachment body 104 rather than the top assembly 102. As illustrated in FIG. 10, in some aspects, the attachment body 104 includes a retaining shell 1052, and the resilient member 110 is retained on the attachment body 104 between the retaining shell 1052 and the slug 142. The retaining shell 1052 may be retained on the attachment body 104 through various suitable mechanisms such that the retaining shell 1052 is movable relative to the attachment body 104 as the top assembly 102 is moved toward the attachment body 104 and as the resilient member 110 biases the top assembly 102 away from the attachment body 104. In such examples, the resilient member 110 may bias the top assembly 102 away from the attachment body 104 by biasing the retaining shell 1052 away from the attachment body 104.

Figure 11:
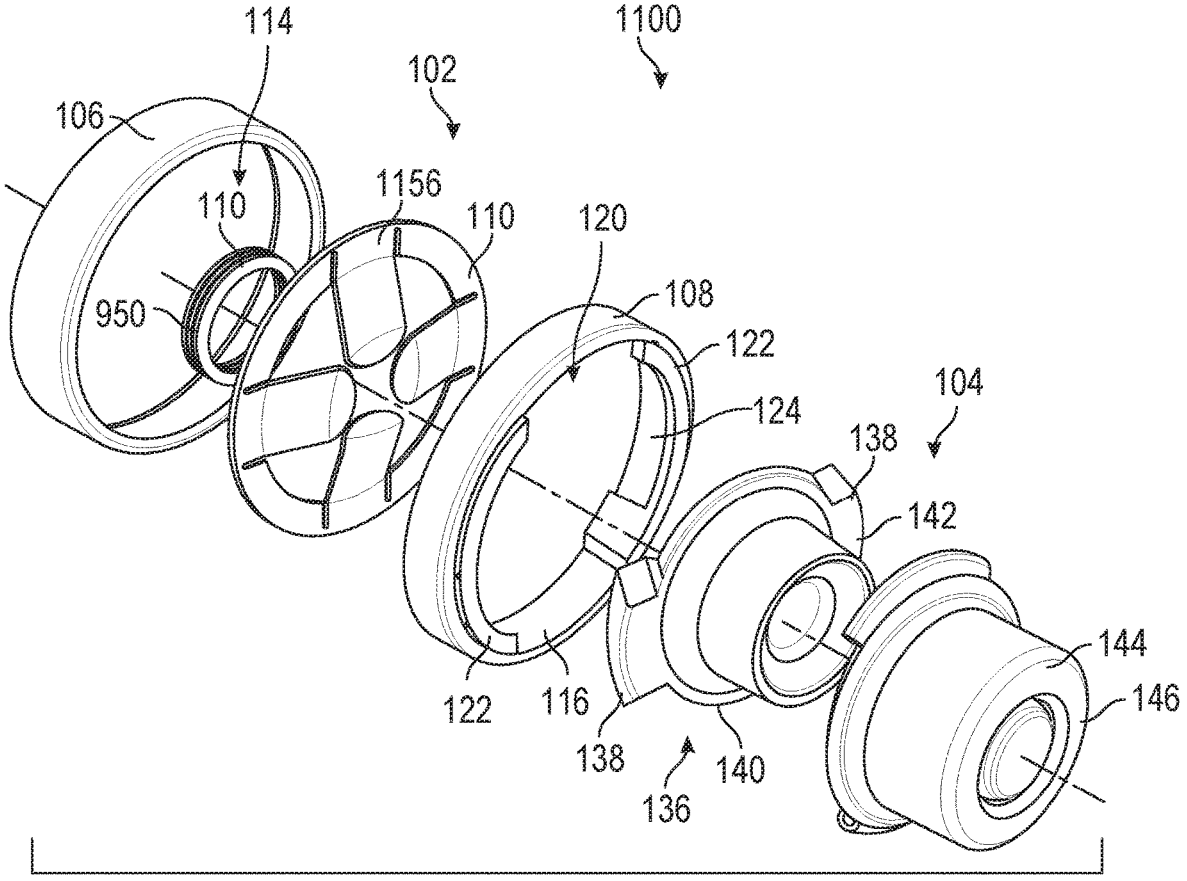
FIG. 11 is an exploded assembly view of a button assembly according to aspects of the current disclosure.

FIG. 11 illustrates another example of a button assembly 1100 according to aspects of the present disclosure. The button assembly 1100 is substantially similar to the button assembly 100 except that the button assembly 1100 includes two resilient members 110 with the top assembly 102. In some examples with two or more resilient members 110, the resilient members 110 may all be the same type of resilient member, although they need not be in other examples. In FIG. 11, one of the resilient members is the wave spring 950, and the other resilient member 110 is a spring washer 1156. In some cases with two or more resilient members, the resilient members 110 may all be with the top assembly 102, all with the attachment body 104, or may be on a combination of the top assembly 102 and the attachment body 104.

Figure 12:
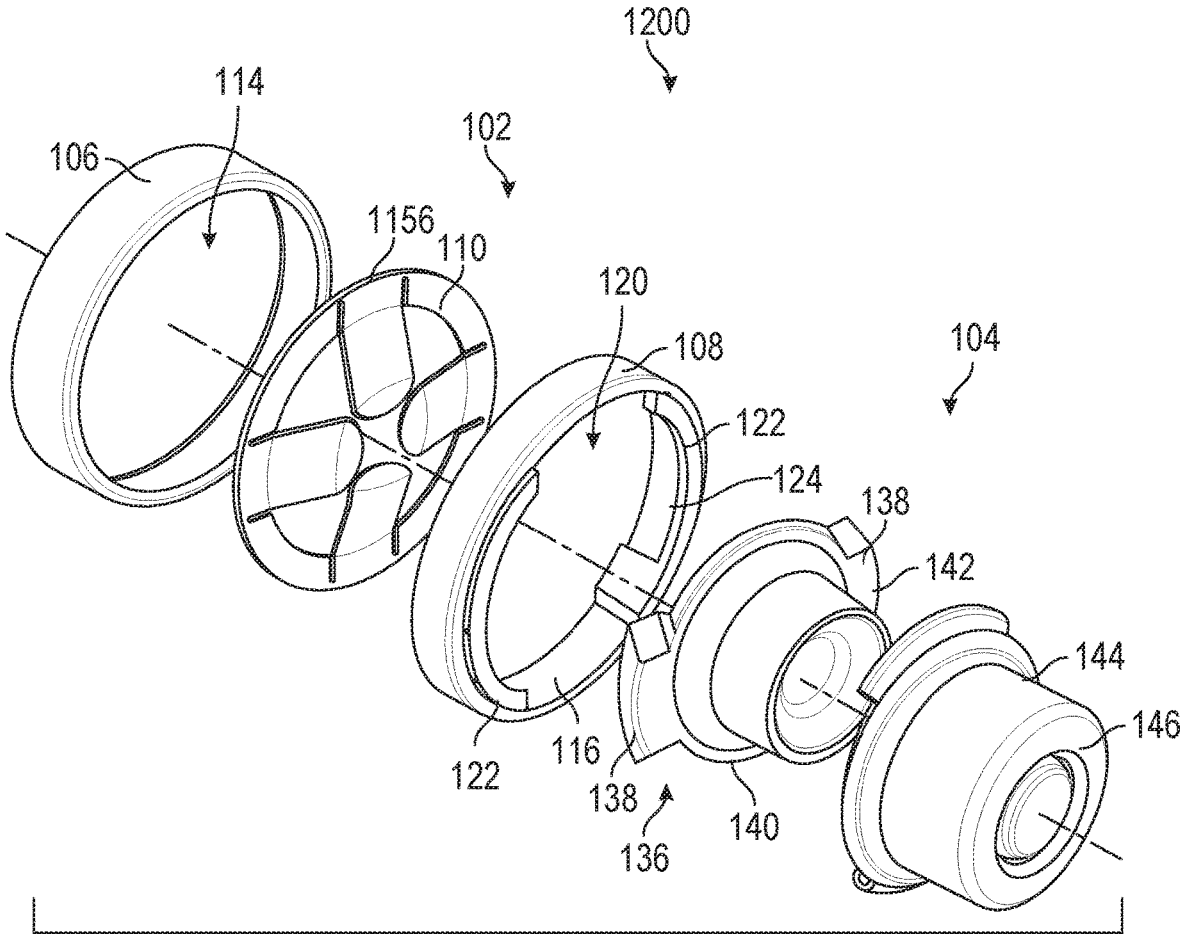
FIG. 12 is an exploded assembly view of a button assembly according to aspects of the current disclosure.

FIG. 12 illustrates another example of a button assembly 1200 according to aspects of the present disclosure. The button assembly 1200 is substantially similar to the button assembly 100 except that the resilient member 110 of the button assembly 1200 is the spring washer 1156.

Figure 13:
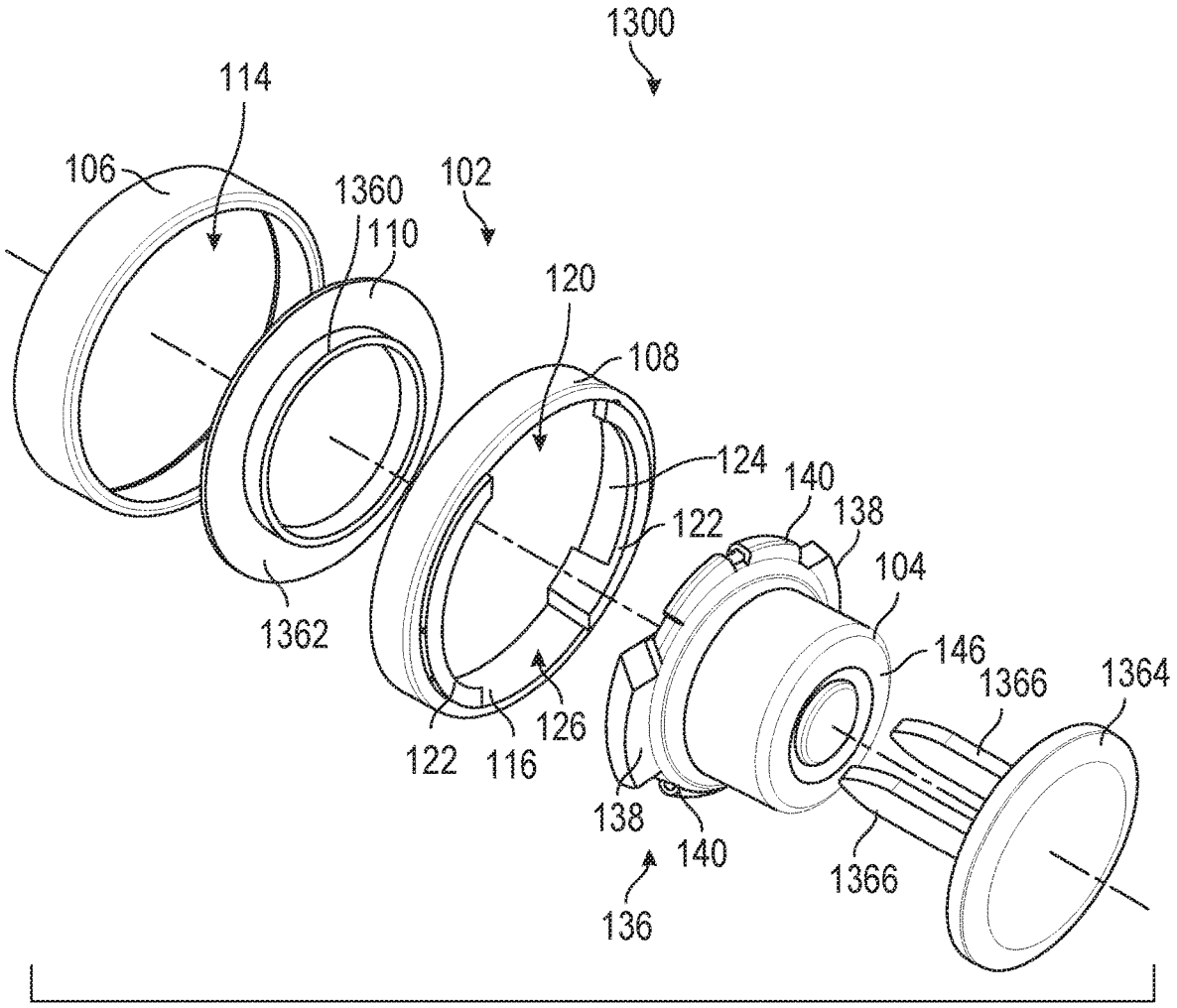
FIG. 13 is an exploded assembly view of a button assembly according to aspects of the current disclosure.
Figure 14:
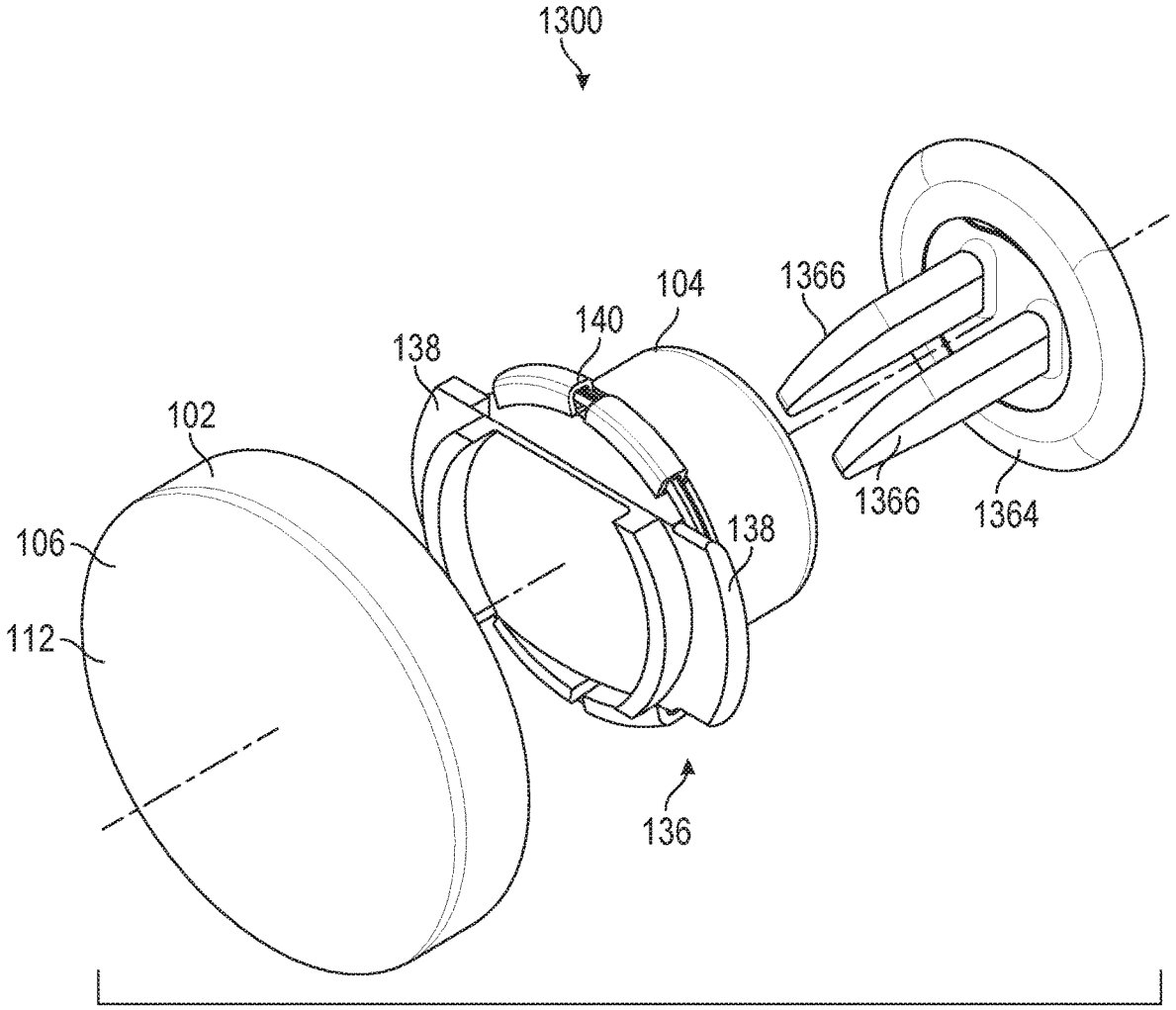
FIG. 14 is another exploded assembly view of the button assembly of FIG. 13.

FIGS. 13 and 14 illustrate another example of a button assembly 1300 according to aspects of the present disclosure. The button assembly 1300 is substantially similar to the button assembly 100 except that the resilient member 110 is a silicone spring 1360 with a biasing plate 1362. FIGS. 13 and 14 also illustrate an example of a fastener 1364 with two prongs 1366.

Figure 15:
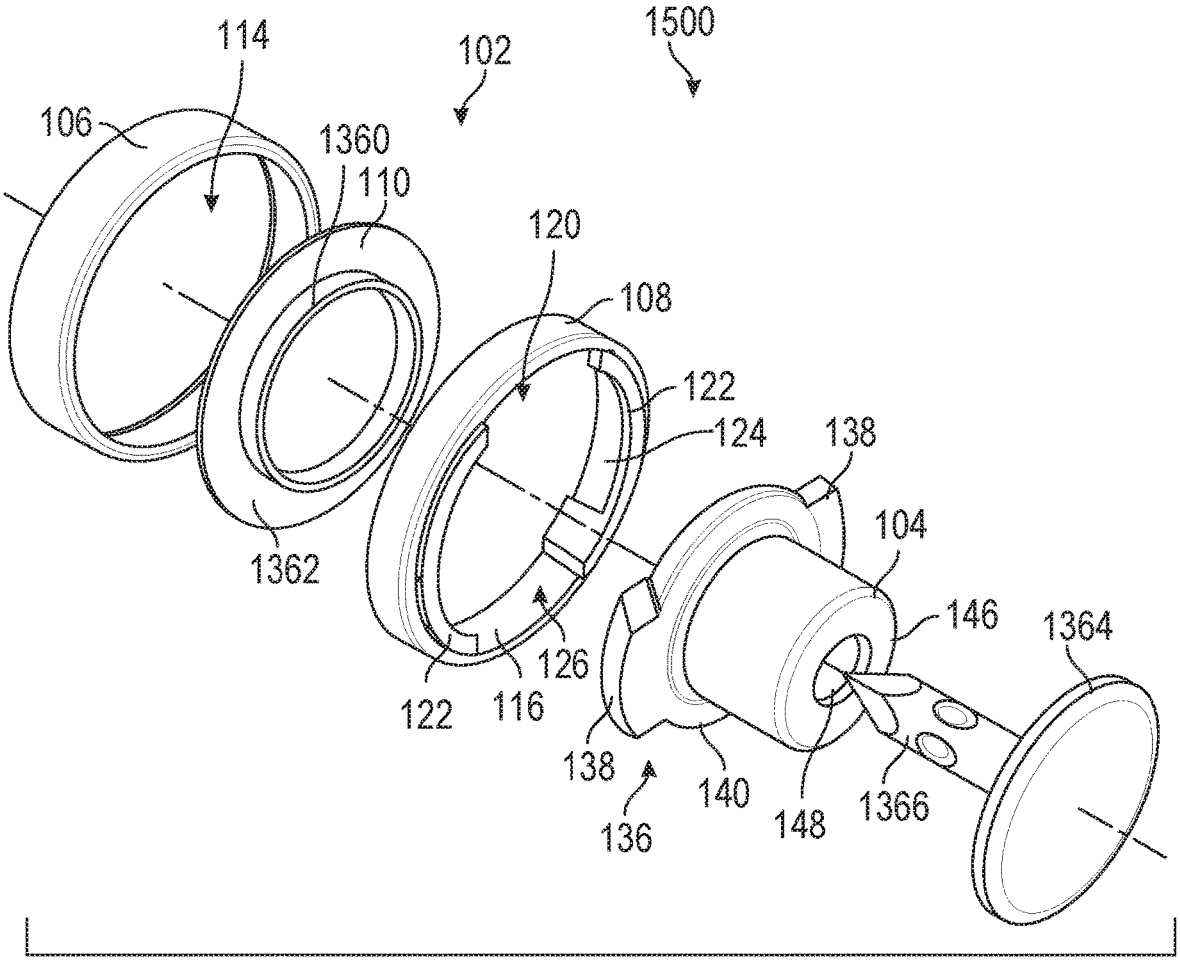
FIG. 15 is an exploded assembly view of a button assembly according to aspects of the current disclosure.

FIG. 15 illustrates another example of a button assembly 1500 that is substantially similar to the button assembly 1300 except that the attachment body 104 is a monolithically formed component that includes the locking feature 136. The attachment body 104 of the button assembly 1500 also includes a single aperture 148 that is adapted to receive a prong 1366 of a fastener 1364 with a single prong.

Figure 16:
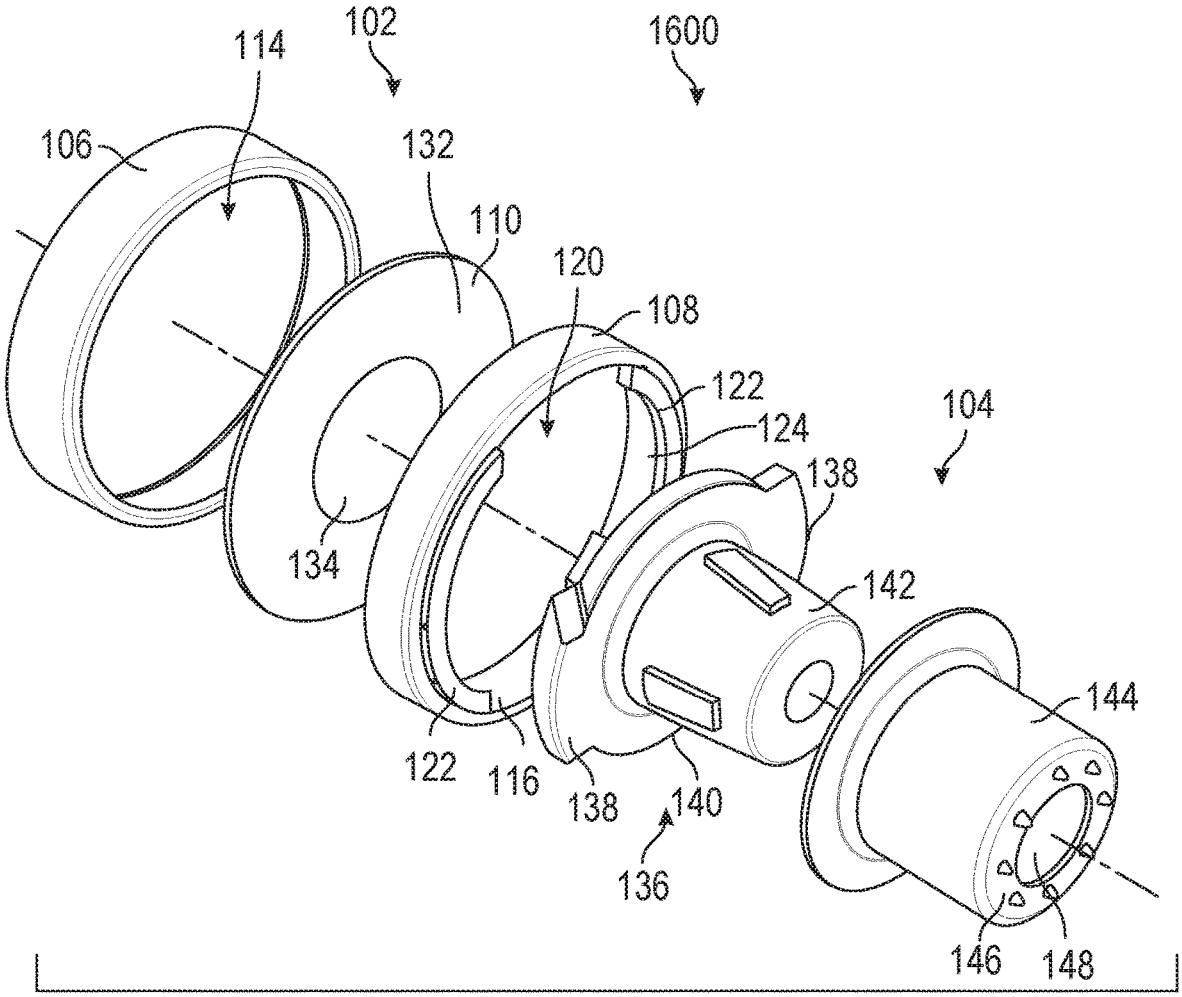
FIG. 16 is an exploded assembly view of a button assembly according to aspects of the current disclosure.

FIG. 16 illustrates another example of a button assembly 1600 according to aspects of the current disclosure. The button assembly 1600 is substantially similar to the button assembly 100 except that the attachment body 104 of the button assembly 1600 includes a single aperture 148 that is adapted to receive a prong 1366 of a single-pronged fastener 1364.

Figure 17:
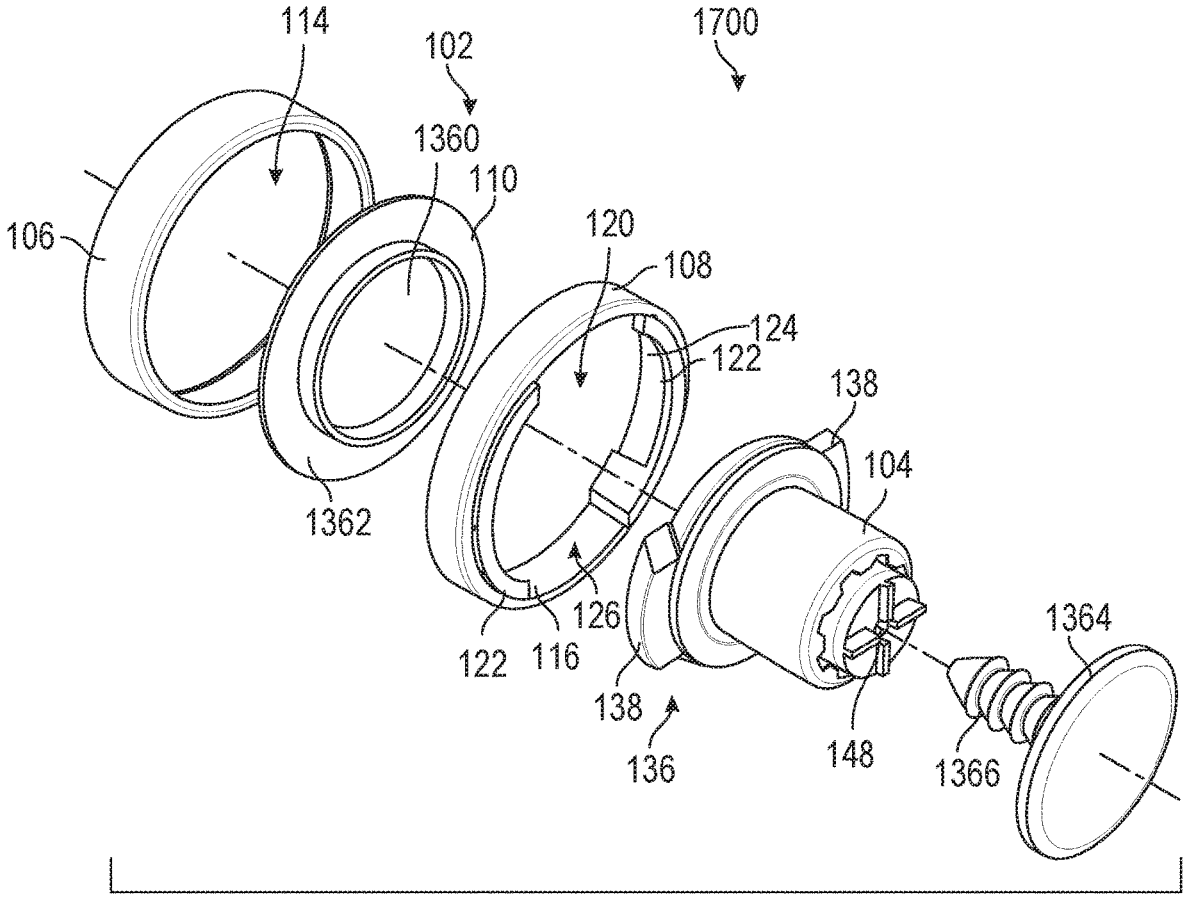
FIG. 17 is an exploded assembly view of a button assembly according to aspects of the current disclosure.

FIG. 17 illustrates another example of a button assembly 1700 according to aspects of the current disclosure. The button assembly 1700 is substantially similar to the button assembly 1500 except that the attachment body 104 is adapted to engage with a different type of single-pronged fastener 1364.

Figure 18:
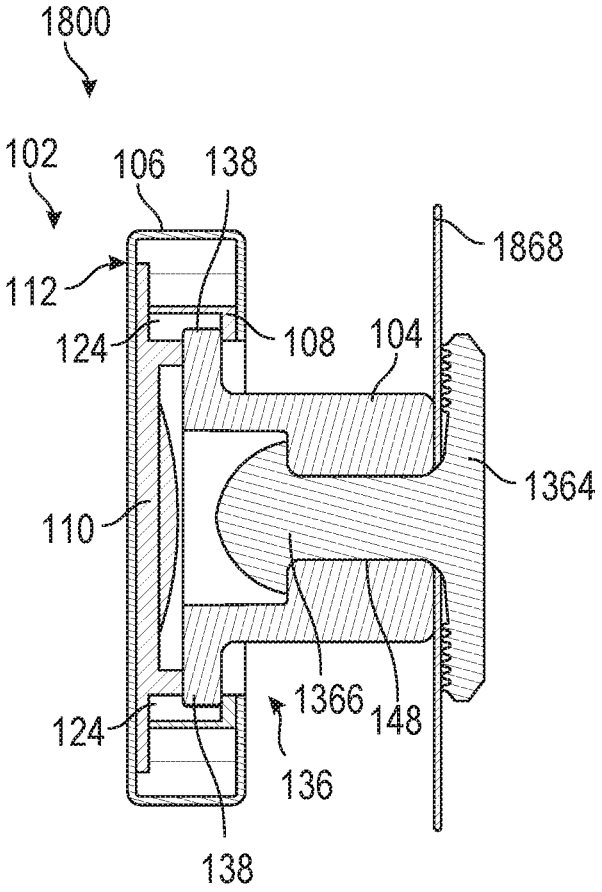
FIG. 18 is a sectional view of a button assembly according to aspects of the current disclosure with a garment and fastener.

FIG. 18 illustrates another example of a button assembly 1800. The button assembly 1800 is substantially similar to the button assembly 1500 but is engageable with a different type of single-pronged fastener 1364. As illustrated in FIG. 18, the button assembly 1800 is supported on a material 1868. It will be appreciated that the other button assemblies may be supported in a similar manner, partially depending on the type of fastener (single-pronged fastener, two-pronged fastener, etc.) As mentioned above, the material 1868 may be various materials on which a button assembly 1800 can be supported. In some examples, the material 1868 may be a fashion or apparel industry material such as various fabrics, leathers, cloths, denim, etc. Supporting the attachment body 104 on the material may include engaging the prong 1366 of the fastener 1364 through the material 1868 and into the aperture 148 of the attachment body 104 such that the attachment body 104 is retained on the material 1868. As illustrated in FIG. 18, in some optional examples, when the attachment body 104 is supported on the material 1868, the locking feature 136 overlaps a portion of the material 1868 such that the attachment body 104 can still function as a button or fastener even if the top assembly 102 is disengaged or removed from the attachment body 104.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents EC 1. A button assembly comprising: a top assembly comprising a cap and a locking ring defining a receiving area, the locking ring comprising a top protrusion extending into the receiving area; an attachment body comprising a locking feature, the locking feature comprising a body protrusion and a notched portion; and a resilient member located between the cap and the attachment body such that the cap is movable toward the attachment body, wherein the top assembly is selectively engageable with the attachment body by aligning the top protrusion of the locking ring with the notched portion of the locking feature, pushing the top assembly toward the attachment body, and rotating the top assembly relative to the attachment body such that the top protrusion of the locking ring is aligned with the body protrusion of the locking feature.

EC 2. The button assembly of any of the preceding or subsequent example combinations, wherein the resilient member is on the top assembly.

EC 3. The button assembly of any of the preceding or subsequent example combinations, wherein the resilient member is on the attachment body.

EC 4. The button assembly of any of the preceding or subsequent example combinations, wherein the cap defines a cap cavity, and wherein the locking ring is retained within the cap cavity.

EC 5. The button assembly of any of the preceding or subsequent example combinations, wherein the locking ring comprises a central axis, and wherein the top protrusion extends inwardly from an inner surface of the locking ring towards the central axis.

EC 6. The button assembly of any of the preceding or subsequent example combinations, wherein the top protrusion further defines a receiving recess that is configured to receive the body protrusion of the locking feature when the top assembly is engaged with the attachment body.

EC 7. The button assembly of any of the preceding or subsequent example combinations, wherein the top protrusion of the locking ring is a first top protrusion, and wherein the locking ring further comprises a second top protrusion opposite from the first top protrusion and a pair of recessed areas on opposing portions of the locking ring between the first top protrusion and the second top protrusion.

EC 8. A button assembly comprising: a top assembly comprising a top protrusion and a cap, wherein the cap defines a receiving area, and wherein the top protrusion extends into the receiving area; an attachment body comprising a locking feature, the locking feature comprising a body protrusion and a notched portion; and a resilient member between the top assembly and the attachment body such that the top assembly is movable toward the attachment body, wherein the top assembly is selectively engageable with the attachment body by aligning the top protrusion with the notched portion of the locking feature, pushing the top assembly toward the attachment body, and rotating the top assembly relative to the attachment body such that the top protrusion is aligned with the body protrusion of the locking feature.

EC 9. The button assembly of any of the preceding or subsequent example combinations, wherein the top assembly further comprises a locking ring positioned within the receiving area and comprising the top protrusion.

EC 10. The button assembly of any of the preceding or subsequent example combinations, wherein the top protrusion defines a receiving recess between the top protrusion and the cap within the receiving area, and wherein the receiving recess is configured to receive the body protrusion of the locking feature when the top assembly is engaged with the attachment body.

EC 11. The button assembly of any of the preceding or subsequent example combinations, wherein the resilient member is on the top assembly.

EC 12. The button assembly of any of the preceding or subsequent example combinations, wherein the resilient member is on the attachment body.

EC 13. The button assembly of any of the preceding or subsequent example combinations, further comprising an alignment guide configured to orient the top assembly relative to the attachment body.

EC 14. The button assembly of any of the preceding or subsequent example combinations, wherein the attachment body comprises a collet and a slug, wherein the collet comprises the locking feature, and wherein the slug is configured to engage with a garment fastener.

EC 15. A method of assembling a top button comprising: positioning a top assembly relative to an attachment body, wherein the top assembly comprises a receiving area and a top protrusion within the receiving area, wherein the attachment body comprises a locking feature comprising a body protrusion and a notched portion, and wherein positioning the top assembly comprises aligning the top protrusion with the notched portion of the locking feature; pushing the top assembly toward the attachment body; and rotating the top assembly relative to the attachment body such that the top protrusion is aligned with the body protrusion of the locking feature.

EC 16. The method of any of the preceding or subsequent example combinations, further comprising supporting the attachment body relative to a covering material by engaging the attachment body with a garment fastener such that a portion of the covering material is retained between the attachment body and the garment fastener.

EC 17. The method of any of the preceding or subsequent example combinations, wherein the locking feature of the attachment body overlaps the covering material such that the attachment body remains attached to the garment fastener even if the top assembly is disengaged from the attachment body.

EC 18. The method of any of the preceding or subsequent example combinations, wherein the top assembly further comprises a cap that defines the receiving area.

EC 19. The method of any of the preceding or subsequent example combinations, wherein pushing the top assembly toward the attachment body comprises compressing a resilient member positioned between the top assembly and the attachment body.

EC 20. The method of any of the preceding or subsequent example combinations, wherein positioning the top assembly relative to the attachment body comprises positioning the top assembly in a predefined position defined by an alignment guide.

EC 21. A removable top button comprising: a top assembly comprising a cap and a locking ring, the locking ring comprising a protruded area; an attachment body comprising a locking feature, the locking feature comprising a recessed area and a protruded area; and a mechanical spring located between the cap and the attachment body such that the cap is movable toward the attachment body, wherein the top assembly is selectively engageable with the attachment body by aligning the protruded area of the locking ring with the recessed area of the locking feature, pushing the top assembly toward the attachment body, and rotating the top assembly relative to the attachment body such that the protruded area of the locking ring is aligned with the protruded area of the locking feature.

EC 22. The removable top button of any of the preceding or subsequent example combinations, wherein the mechanical spring is on the top assembly.

EC 23. The removable top button of any of the preceding or subsequent example combinations, wherein the mechanical spring is on the attachment body.

EC 24. A method of assembling a top button comprising: positioning a top assembly relative to an attachment body, wherein the top assembly comprises a cap and a locking ring comprising a protruded area, wherein the attachment body comprises a locking feature comprising a protruded area and a recessed area, and wherein positioning the top assembly comprises aligning the protruded area of the locking ring with the recessed area of the locking feature; pushing the top assembly toward the attachment body; and rotating the cap relative to the attachment body such that the protruded area of the locking ring is aligned with the protruded area of the locking feature.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The invention claimed is:

1. A button assembly comprising:

a top assembly comprising a cap and a locking ring defining a receiving area, the locking ring comprising a top protrusion extending into the receiving area;

an attachment body comprising a locking feature, the locking feature comprising a body protrusion and a notched portion; and a resilient member located between the cap and the attachment body such that the cap is movable toward the attachment body, wherein the top assembly is selectively engageable with the attachment body by aligning the top protrusion of the locking ring with the notched portion of the locking feature, pushing the top assembly toward the attachment body, and rotating the top assembly relative to the attachment body such that the top protrusion of the locking ring is aligned with the body protrusion of the locking feature.

2. The button assembly of claim 1, wherein the resilient member is on the top assembly.

3. The button assembly of claim 1, wherein the resilient member is on the attachment body.

4. The button assembly of claim 1, wherein the cap defines a cap cavity, and wherein the locking ring is retained within the cap cavity.

5. The button assembly of claim 1, wherein the locking ring comprises a central axis, and wherein the top protrusion extends inwardly from an inner surface of the locking ring towards the central axis.

6. The button assembly of claim 5, wherein the top protrusion further defines a receiving recess that is configured to receive the body protrusion of the locking feature when the top assembly is engaged with the attachment body.

7. The button assembly of claim 5, wherein the top protrusion of the locking ring is a first top protrusion, and wherein the locking ring further comprises a second top protrusion opposite from the first top protrusion and a pair of recessed areas on opposing portions of the locking ring between the first top protrusion and the second top protrusion.

8. A button assembly comprising:

a top assembly comprising a top protrusion and a cap, wherein the cap defines a receiving area, and wherein the top protrusion extends into the receiving area;

an attachment body comprising a locking feature, the locking feature comprising a body protrusion and a notched portion; and a resilient member located between the top assembly and the attachment body such that the top assembly is movable toward the attachment body, wherein the top assembly is selectively engageable with the attachment body by aligning the top protrusion with the notched portion of the locking feature, pushing the top assembly toward the attachment body, and rotating the top assembly relative to the attachment body such that the top protrusion is aligned with the body protrusion of the locking feature.

9. The button assembly of claim 8, wherein the top assembly further comprises a locking ring positioned within the receiving area and comprising the top protrusion.

10. The button assembly of claim 8, wherein the top protrusion defines a receiving recess between the top protrusion and the cap within the receiving area, and wherein the receiving recess is configured to receive the body protrusion of the locking feature when the top assembly is engaged with the attachment body.

11. The button assembly of claim 8, wherein the resilient member is on the top assembly.

12. The button assembly of claim 8, wherein the resilient member is on the attachment body.

13. The button assembly of claim 8, further comprising an alignment guide configured to orient the top assembly relative to the attachment body.

14. The button assembly of claim 8, wherein the attachment body comprises a collet and a slug, wherein the collet comprises the locking feature, and wherein the slug is configured to engage with a garment fastener.

15. A method of assembling a top button comprising:

positioning a top assembly relative to an attachment body, wherein the top assembly comprises a receiving area and a top protrusion within the receiving area, wherein the attachment body comprises a locking feature comprising a body protrusion and a notched portion, and wherein positioning the top assembly comprises aligning the top protrusion with the notched portion of the locking feature;

pushing the top assembly toward the attachment body; and rotating the top assembly relative to the attachment body such that the top protrusion is aligned with the body protrusion of the locking feature.

16. The method of claim 15, further comprising supporting the attachment body relative to a covering material by engaging the attachment body with a garment fastener such that a portion of the covering material is retained between the attachment body and the garment fastener.

17. The method of claim 16, wherein the locking feature of the attachment body overlaps the covering material such that the attachment body remains attached to the garment fastener even if the top assembly is disengaged from the attachment body.

18. The method of claim 15, wherein the top assembly further comprises a cap that defines the receiving area.

19. The method of claim 15, wherein pushing the top assembly toward the attachment body comprises compressing a resilient member positioned between the top assembly and the attachment body.

20. The method of claim 15, wherein positioning the top assembly relative to the attachment body comprises positioning the top assembly in a predefined positioned defined by an alignment guide.

* * * * *